US010539971B2

(12) United States Patent
Petrovic

(10) Patent No.: US 10,539,971 B2
(45) Date of Patent: Jan. 21, 2020

(54) ADAPTIVE VOLTAGE SCALING CIRCUITRY

(71) Applicant: VIASAT, INC., Carlsbad, CA (US)

(72) Inventor: Branislav Petrovic, La Jolla, CA (US)

(73) Assignee: Viasat, Inc., Carlsbad, CA (US)

( * ) Notice: Subject to any disclaimer, the term of this patent is extended or adjusted under 35 U.S.C. 154(b) by 112 days.

(21) Appl. No.: 15/069,560

(22) Filed: Mar. 14, 2016

(65) Prior Publication Data

US 2017/0262004 A1 Sep. 14, 2017

(51) Int. Cl.

| | |
|---|---|
| ***G05F 1/46*** | (2006.01) |
| ***G05F 1/59*** | (2006.01) |
| *G05F 1/563* | (2006.01) |

(52) U.S. Cl.

CPC ..... *G05F 1/46* (2013.01); *G05F 1/465* (2013.01); *G05F 1/59* (2013.01); *G05F 1/563* (2013.01)

(58) Field of Classification Search

CPC . G05F 3/205; G05F 1/46; G05F 1/462; G05F 1/465; G05F 1/468; G05F 1/10; G05F 1/56; G05F 1/563; G05F 1/569; G05F 1/575; G05F 1/614; H02M 2001/0067; H02M 2001/007; H02M 2001/0074

See application file for complete search history.

(56) References Cited

U.S. PATENT DOCUMENTS

| | | | | |
|---|---|---|---|---|
| 5,994,886 | A * | 11/1999 | Shinozaki | G05F 1/465 323/303 |
| 8,884,685 | B1 | 11/2014 | Petrovic | |
| 2006/0091937 | A1* | 5/2006 | Do | G05F 1/465 327/538 |
| 2007/0069808 | A1* | 3/2007 | Do | G05F 1/465 327/541 |
| 2010/0244951 | A1* | 9/2010 | Smith | H04W 52/0277 330/127 |
| 2013/0271107 | A1* | 10/2013 | Grossier | G05F 1/56 323/349 |
| 2014/0145696 | A1* | 5/2014 | Hoshino | H03M 1/0609 323/283 |
| 2015/0323895 | A1* | 11/2015 | Obata | G05F 1/56 399/88 |
| 2016/0048147 | A1* | 2/2016 | Abhishek | G05F 1/468 323/313 |
| 2017/0063229 | A1* | 3/2017 | Powell | G05F 1/59 |

* cited by examiner

*Primary Examiner* — Gustavo A Rosario-Benitez
(74) *Attorney, Agent, or Firm* — Holland & Hart LLP

(57) ABSTRACT

A circuit may include a first voltage regulator to supply a main circuit and a second voltage regulator to supply a test circuit. The test circuit may produce a test signal having a characteristic dependent on the second regulated supply voltage. A controller may adjust second voltage regulator to a threshold level to induce a change in the characteristic of the test signal. The controller may adjust the first voltage regulator based on the threshold level of the second regulated supply voltage.

20 Claims, 7 Drawing Sheets

ADAPTIVE VOLTAGE SCALING CIRCUITRY

BACKGROUND

The speed of an integrated circuit (IC) in a given technology (e.g., 28 nm CMOS, complementary metal oxide semiconductor) is primarily affected by process variations, supply (core) voltage, and operating temperature (PVT). In general, circuit operating speeds (e.g., transistor switching time) decreases with supply voltage and increases with operating temperature. Worst case timing typically occurs with the setup time on one or more critical paths in a slowest process corner IC operating at high temperatures. In some cases, the hold time may be the limitation, which may occur with a fast process IC operating at low temperatures.

To guarantee operation in such worst case situations, the power supply voltage to the core can be adjusted to be high enough to ensure that the slowest process IC meets the timing requirements. However, while ensuring operation of the slow process IC, the high supply voltage can result in increased power consumption by a fast process IC, since faster ICs typically draw more current at a given frequency. In smaller geometries, particularly at 28 nm and lower, the leakage current becomes dominant, as it tends to be higher than the dynamic switching power. The leakage power exponentially increases with voltage, dramatically aggravating the problem.

Various approaches to mitigate such excessive power consumption use a technique referred to as dynamic voltage scaling (DVS) by which the voltage is dynamically adjusted during operation of the IC to counteract the temperature effects. Some solutions, for example, measure the frequency of a reference circuit (e.g., a free running ring oscillator) during operation as being representative of the process speed and operating temperature. The supply voltage may be adjusted to bring the frequency to a target value, which is typically a predetermined value based on simulations, characterizations, statistical data collected over process variation and temperature, and so on. A wide margin is typically built into the target value to guarantee operation of ICs at all the process corners and operating conditions. The wide margin tends to result in a high supply voltage setting, thus defeating the goal of voltage scaling.

Other solutions measure process speed during IC testing (e.g., by measuring a ring oscillator frequency at nominal voltage and nominal—room—temperature) and store those values in a set of fuses. During operation, the supply voltage can be dynamically scaled to drive the ring oscillator frequency to a target value determined as a function of process speed and operating temperature. Target values for ring oscillator frequency vs. process and temperature may be obtained by characterization of split lots representing process corners and measurements of large sample sizes over temperature.

SUMMARY

In accordance with aspects of the present disclosure, a circuit may include a first voltage regulator to produce a first regulated supply voltage for a main circuit. A second voltage regulator may be included and configured to produce a second regulated supply voltage. A test circuit may be included and configured to produce a test signal having a characteristic dependent on the second regulated supply voltage. A controller maybe be included and configured to control the second voltage regulator to adjust the second regulated supply voltage to a threshold level to induce a change in the characteristic of the test signal. The controller may control the first voltage regulator to adjust the first regulated supply voltage based on the threshold level of the second regulated supply voltage.

In accordance with aspects of the present disclosure, a method in a circuit may include producing a first regulated supply voltage for a main circuit. A second regulated supply voltage may be produced for a test circuit. A test signal may be produced by the test circuit, having a characteristic dependent on the second regulated supply voltage. The second regulated supply voltage may be adjusted to a threshold level to induce a change in the characteristic of the test signal, and the first regulated supply voltage may be adjusted based on the threshold level.

The following detailed description and accompanying drawings provide a better understanding of the nature and advantages of the present disclosure.

BRIEF DESCRIPTION OF THE DRAWINGS

With respect to the discussion to follow and in particular to the drawings, it is stressed that the particulars shown represent examples for purposes of illustrative discussion, and are presented in the cause of providing a description of principles and conceptual aspects of the present disclosure. In this regard, no attempt is made to show implementation details beyond what is needed for a fundamental understanding of the present disclosure. The discussion to follow, in conjunction with the drawings, makes apparent to those of skill in the art how embodiments in accordance with the present disclosure may be practiced. In the accompanying drawings.

DETAILED DESCRIPTION

In the following description, for purposes of explanation $V_{DD}$-test, numerous examples and specific details are set forth in order to provide a thorough understanding of the present disclosure. It will be evident, however, to one skilled in the art that the present disclosure as expressed in the claims may include some or all of the features in these examples, alone or in combination with other features described below, and may further include modifications and equivalents of the features and concepts described herein.

Figure 1:
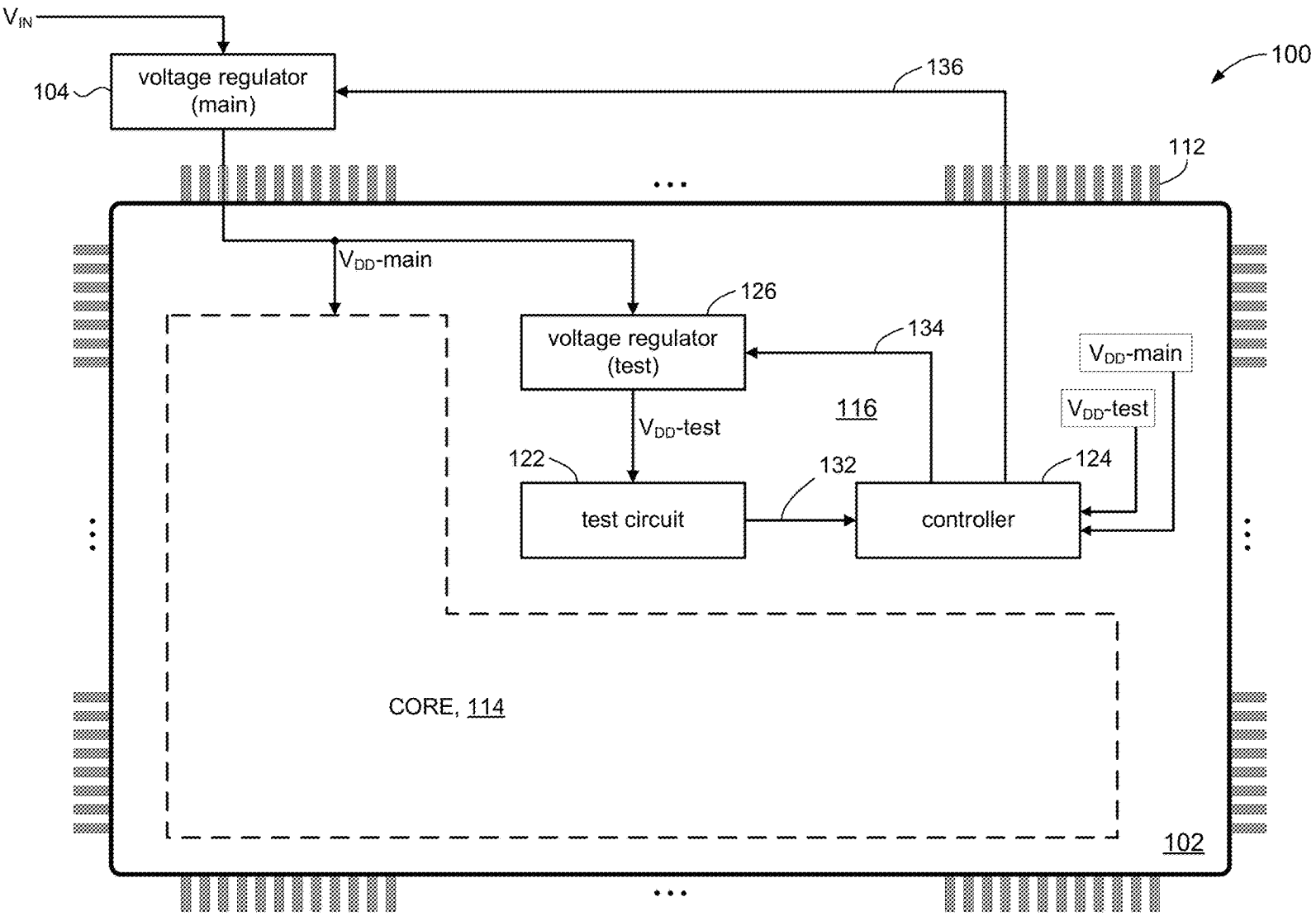
FIG. 1 illustrates a block diagram showing elements of a circuit in accordance with the present disclosure.

Referring to FIG. 1, in some embodiments, a circuit 100 may comprise an integrated circuit (IC) 102 and a (main) voltage regulator 104. The main regulator 104 may be configured to produce a regulated supply voltage (e.g., $V_{DD}$-main or simply $V_{DD}$, referred to herein as "main supply voltage") from an input voltage $V_{IN}$. For example, the input voltage $V_{IN}$ may be obtained from a power rail on a printed circuit board (PCB, not shown) that IC 102 and main regulator 104 are mounted on. The main supply voltage $V_{DD}$-main may be provided to IC 102 via one or more pins 112 used to carry signals (analog and/or digital) to and from the IC 102. The main regulator 104 may be any suitable voltage regulator design. In some embodiments, for example, the main regulator 104 may be a switched regulator design; e.g., a buck regulator, boost regulator, etc. In other embodiments, the main regulator 104 may be a linear voltage regulator; e.g., a low dropout (LDO) regulator.

IC 102 may include a core 114. The core 114 may be supplied (powered) by the main supply voltage $V_{DD}$-main and provided to IC 102 via one or more pins 112. In some embodiments, the core 114 may represent main circuitry that implements at least some of the functionality of IC 102. For example, if IC 102 is a microprocessor, the core 114 may represent the logic circuits that implement some or all of the components of a microprocessor; e.g., central processing unit, arithmetic logic unit, I/O logic, etc. If IC 102 is a memory device, the core 114 may represent the logic circuits that implement some or all of the components of a memory; e.g., address decode logic, memory cells, etc; and so on.

In accordance with the present disclosure, IC 102 may include adaptive voltage scaling (AVS) circuitry 116 configured to adaptively scale the main supply voltage $V_{DD}$-main to compensate for variations in circuit operation in the core 114. In some embodiments, the AVS circuitry 116 may include a test circuit 122, a controller 124, and a (test) voltage regulator 126. The test regulator 126 may be configured to produce a regulated supply voltage (e.g., $V_{DD}$-test, referred to herein as "test supply voltage") to supply power to the test circuit 122.

In accordance with the present disclosure, the test circuit 122 may be circuitry that is separate from the main circuitry that comprises the core 114, but is nonetheless representative of circuitry in the core 114. In some embodiments, for example, the test circuit 122 may be fabricated using the same cell library (or cell libraries) used in the design of the core 114 (e.g., 7-track cell library, 10-track cell library, etc.) so that the test circuit 122 is representative of the core 114 in terms of operating characteristics. The test circuit 122 may comprise a similar selection of devices as used in the core 114 such as, for example, ultra-high $V_{th}$ (UHVT) transistors, high $V_{th}$ (HVT) transistors, standard $V_{th}$ (SVT) transistors, low $V_{th}$ (LVT) transistors, and ultra-low $V_{th}$ (ULVT) transistors. The test circuit 122 may include circuitry that is identical to circuitry (e.g., ring oscillators, flip flops, frequency dividers, etc.) in the core 114 so as to represent or emulate critical elements and critical signal paths in the core 114; e.g., cascaded stages and circuits, interconnect circuits including metal layer interconnects, emulating propagation delay of critical elements, etc. In some embodiments, the test circuit 122 may include circuits that are different from circuitry in the core 114.

The test circuit 122 may be configured with operating characteristics that can manifest themselves in a detectable way to facilitate the determination of failure when the test supply voltage $V_{DD}$-test, which powers test circuit 122, drops below a threshold failure voltage $V_{FAIL}$; e.g., $V_{DD}$-test$<V_{FAIL}$. It should be noted that "failure" in this context means incorrect operation or function of a circuit or device, which is reversible by restoring the test supply voltage $V_{DD}$-test to a level$\geq V_{FAIL}$, rather than a physical or otherwise irreversible failure or damage of the circuit or device. In some embodiments, for instance, the test circuit 122 may have some characteristic (e.g., a critical timing parameter such as setup and hold time) that can be directly or indirectly monitored; e.g., by monitoring one or more signals generated by the test circuit 122. A failure in the context of the present disclosure may be indicated by a deviation of that characteristic from nominal or otherwise expected behavior. To illustrate the point, suppose the test circuit 122 includes a frequency divider. Any setup time or hold time violations in the frequency divider (e.g., due to the test supply voltage $V_{DD}$-test being too low) may produce an erroneous division and be detected as an incorrect output frequency from the test circuit 122. However, resumption of proper operation in the test circuit 122 may be observed if the test supply voltage $V_{DD}$-test is restored to a sufficiently high level.

In accordance with some embodiments, the controller 124 may be configured to produce a control signal 134 to adjust test supply voltage $V_{DD}$-test of test regulator 126. In some embodiments, for example, the control signal 134 may be an analog signal, if the test regulator 126 is an analog circuit. In other embodiments the control signal 134 may be digital, comprising one or more bit lines to control a digitally-based test regulator 126. The controller 124 may also produce a control signal 136 that can be provided to the main regulator 104 (e.g., via one of the pins 112) to adjust the main supply voltage $V_{DD}$-main. In some embodiments, the control signal 136 may be an analog signal (e.g., if the main regulator 104 is an analog circuit), and in other embodiments the control signal 136 may be digital (e.g., comprising one or more bit lines to control a digitally-based main regulator 104). In addition to representing control signals 134, 136, the reference numerals 134, 136 shown in FIG. 1 may also represent signal lines or traces formed on the die (substrate) of IC 102 to communicate the respective control signals 134, 136 from the controller 124 to the regulators 126, 104. Specific operations of the controller 124 are described below.

In accordance with some embodiments, the controller 124 may be configured to detect, sense, or otherwise determine a change in the operation of the test circuit 122 to determine the occurrence of a failure in the test circuit 122. The controller 124 may monitor one or more characteristics of one or more (test) signals 132 generated in test circuit 122. In some embodiments, for example, signal lines may be provided between circuitry in the test circuit 122 and inputs to the controller 124. Based on changes detected in the characteristics of the signals 132, the controller 124 may determine whether a failure in test circuit 122 has occurred.

In accordance with some embodiments, the controller 124 may be configured to measure the main supply voltage $V_{DD}$-main and the test supply voltage $V_{DD}$-test. FIG. 1, for example, shows that the main supply voltage $V_{DD}$-main and the test supply voltage $V_{DD}$-test may be supplied to inputs of the controller 124. The controller 124 may include conversion circuitry (e.g., analog to digital converter, ADC) to convert the voltage levels to a suitable format that can be used by the controller 124. In other embodiments (not shown), such conversion circuitry may be separate from the controller 124. This aspect of the present disclosure will be explained in further detail below.

The signals 132 may be analog signals. For example, if the test circuit 122 includes a frequency generator, a signal 132 produced by the frequency generator may be an analog signal. Frequency may be a characteristic of the signal 132. Accordingly, a failure may be flagged if the frequency of the signal 132 falls outside an acceptable range of frequencies. In some embodiments, a failure may be determined based on a relation between two or more signals 132 generated by the test circuit 122. For example, the timing or phase angle between two signals 132 generated in the test circuit 122 may serve as a basis for identifying a failure in the test circuit 122. Other characteristics may include voltage levels, current levels, signal quality, and so on.

The signals 132 may be digital signals. For example, the test circuit 122 may perform computations (e.g., parity check, autocorrelation product, etc.) on a set of test data. The signals 132 may comprise bit lines that output a numerical result of the computation performed by the test circuit 122. The numerical result may be a characteristic of the signals 132. If the test circuit 122 functions properly, the same numerical result would be computed with each cycle of calculations on the same test data. A different numerical result may indicate failure in the test circuit 122. Other characteristics may include bit counts, bit errors, logic values, and so on.

Figure 1A:
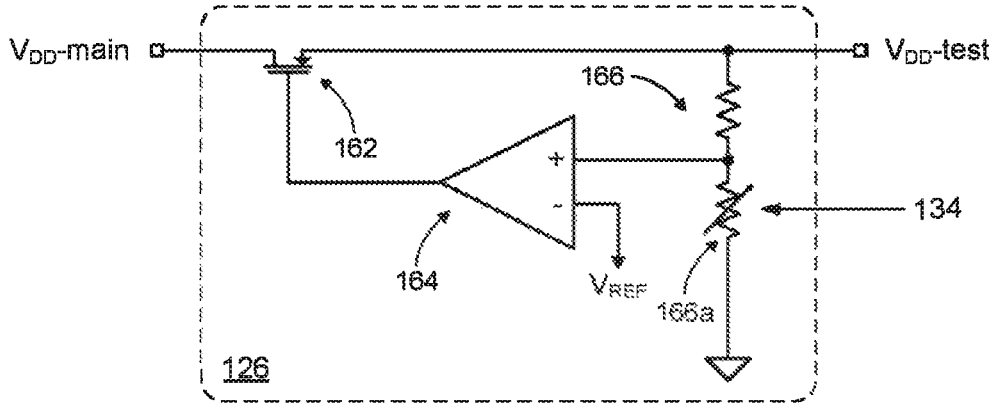
FIG. 1A shows an example of an LDO amplifier in accordance with the present disclosure.

The test regulator 126 may be any suitable voltage regulator design. In some embodiments, for example, the test regulator 126 may be an LDO voltage regulator. Referring to FIG. 1A for a moment, the basic design of test regulator 126 using an LDO design is shown. An input voltage (e.g., $V_{DD}$-main) may be applied to a pass element 162. The pass element 162, for example, may be an N-channel FET (field effect transistor) as shown, but can be a P-channel FET, an NPN or PNP transistor, and the like. The pass element 162 may operate in the linear region to drop the input voltage down to a desired output voltage (e.g., $V_{DD}$-test). The output voltage may be sensed by an error amplifier 164 (e.g., via voltage divider 166) and compared to a reference voltage VREF. In some embodiments, for example, the reference voltage VREF may be a bandgap voltage reference. The error amplifier 164 may drive the pass element 162 to an appropriate operating point to regulate the output voltage so as to drive the difference across the non-inverting (+) and inverting (−) terminals of the error amplifier 164 toward zero, thus completing the control loop. Accordingly, as the output current or input voltage changes, the error amplifier 164 can modulate the pass element 162 to maintain a constant (regulated) output voltage.

The control signal 134 from controller 124 may be used to adjust the output voltage. In some embodiments, for example, the control signal 134 may adjust a variable resistor 166*a* that comprises the voltage divider 166. In an embodiment, for example, the variable resistor 166*a* may be a bank of switched resistors. Adjusting the value of the variable resistor 166*a* changes the voltage divider ratio of the voltage divider 166, and hence the proportion of the output voltage that feeds back to the error amplifier 164. This, in turn, can change the level that the output voltage is regulated to.

In some embodiments, test regulator 126 may be supplied by the main regulator 104, as shown in FIG. 1 for example. The test regulator 126 may be designed with a relatively narrow loop bandwidth in order not to reject ripple and noise from the main regulator 104. The test regulator 126 need only shift the DC component of the regulated output $V_{DD}$-main produced by the main regulator 104, while preserving the AC component to allow any ripple and noise that may exist on the main supply voltage $V_{DD}$-main to pass through to the test circuit 122. In this way, any voltage artifacts in the main supply voltage $V_{DD}$-main that may adversely affect operation of the core 114 may be reflected as a similar adverse effect on the operation of the test circuit 122.

Figure 2A:
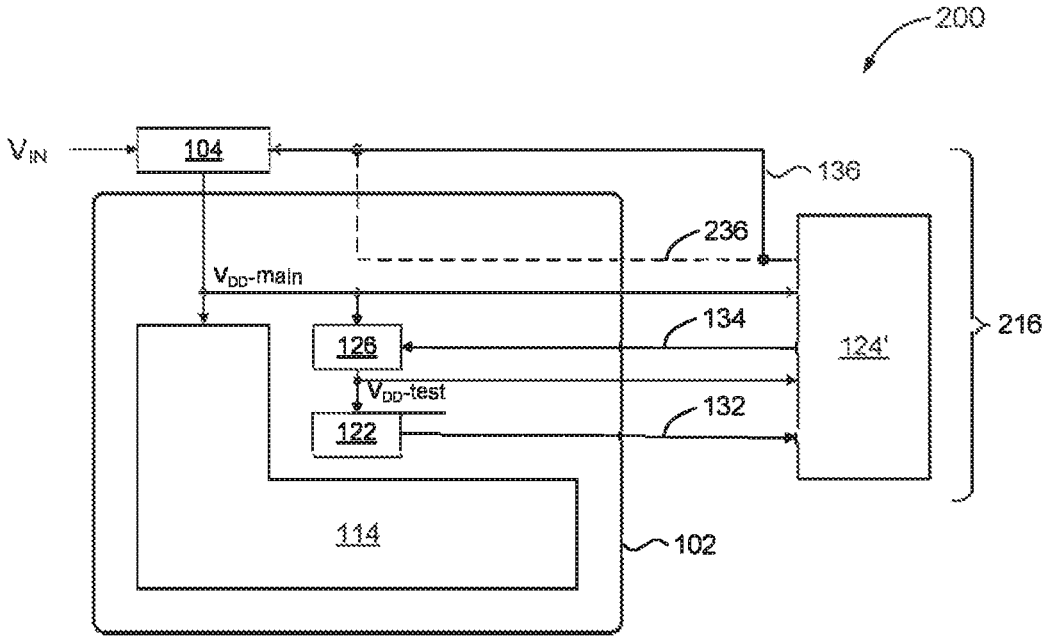
FIGS. 2A and 2B illustrate alternative embodiments of the circuit shown in FIG. 1 in accordance with the present disclosure.

As mentioned above, and which will be explained in further detail below, changes in the detected behavior of test circuit 122 may serve as a basis for adjusting the main supply voltage $V_{DD}$-main in order to compensate for changes in operating conditions. Accordingly, circuits comprising the AVS circuitry 116 that do not serve as a basis for adjusting the main supply voltage $V_{DD}$-main may be provided off-chip. Referring to FIG. 2A, for example, in some embodiments a circuit 200 may include AVS circuitry 216 comprising test circuit 122, a controller 124', and test regulator 126. The controller 124' may be off-chip with respect to IC 102. The controller 124' is "off-chip" in the sense that the controller 124' is not fabricated on the same die (substrate) as IC 102. For example, controller 124' may be fabricated on an IC (not shown) that is separate from IC 102. Such an off-chip configuration may be suitable, for example, if chip area on IC 102 is needed to accommodate the core 114.

Signals 132 from test circuit 122, which is on-chip with respect to IC 102, may be provided to controller 124', for example, via one or more pins 112 (FIG. 1) of IC 102. Likewise, the control signal 134 from controller 124' may be provided to the test regulator 126, which is on-chip with respect to IC 102, via the pins 112. FIG. 2A shows that in some embodiments, control signal 136 from controller 124' may be routed directly to the main regulator 104, for example, via traces formed on a PCB (not shown) that the IC 102 can be mounted on. In other embodiments, the control signal 136 may be routed through the IC 102 (e.g., via pins 112) from the controller 124' to the main regulator 104. FIG. 2A, for instance, shows an example of a control signal 236 being routed through IC 102; e.g., via traces formed on die that comprises IC 202. Such a configuration can avoid having to run a separate trace on a PCB, which may ease routing requirements on the PCB.

The main supply voltage $V_{DD}$-main and the test supply voltage $V_{DD}$-test may be provided to the controller 124' via one or more pins 112. In other embodiments (not shown), the main supply voltage $V_{DD}$-main may be routed from the main regulator 104 to the controller 124' via traces formed on a PCB.

Figure 2B:
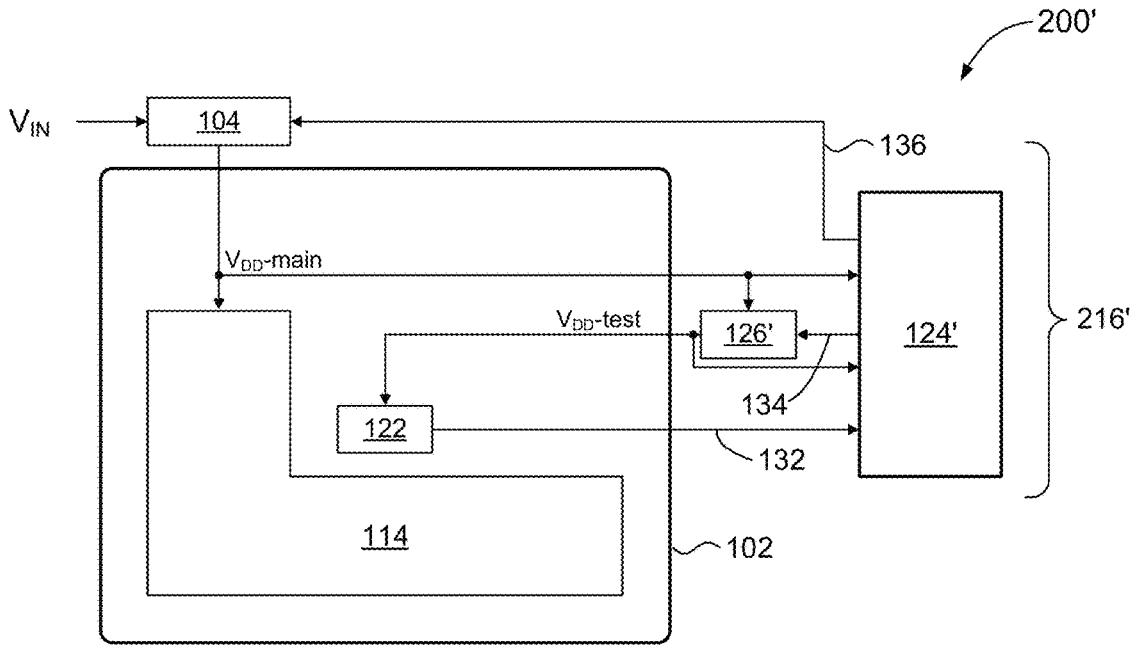

Referring to FIG. 2B, in some embodiments, a circuit 200' may include AVS circuitry 216' comprising test circuit 122, a controller 124', and test regulator 126'. The test regulator 126' may be provided off-chip with respect to IC 102, in addition to controller 124' being provided off-chip. In some embodiments, the test regulator 126' may be co-located with controller 124' (e.g., both being fabricated on an IC, not shown, separate from IC 102). In other embodiments, the test regulator 126' and controller 124' may be separate (e.g., fabricated on different IC's, not shown). Test regulator 126' may provide a test supply voltage (e.g., $V_{DD}$-test) to provide power to test circuit 122 via one or more of the pins 112 (FIG. 1). FIG. 2B shows that the main regulator 104 supplies the test regulator 126' through IC 102. In other embodiments (not shown), the main regulator 104 may directly supply test regulator 126', for example, via one or more traces formed on a PCB that IC 102 may be mounted on. In yet other embodiments (not shown), the controller (e.g., 124, FIG. 1) may be provided on-chip, while the test regulator (e.g., 126) may be provided off-chip.

It can be assumed without loss of generality that the main regulator 104 and the test regulator 126 both produce positive regulated supply voltages. It is understood that in other embodiments, either the main supply 104 or the test supply 126, or both the main supply 104 and the test supply 126, may produce a regulated supply voltage that is negative. When the discussion describes increasing (or decreasing) the output levels of the main supply 104 and the test supply 126 (which are positive), one of ordinary skill will understand that the reverse action, namely decreasing (or increasing), would be performed in embodiments where the main supply 104 or the test supply 126 outputs a negative voltage level. When the discussion uses terms that express limits, such as "maximum" or "highest" for example, one of ordinary skill will understand that terms expressing the reverse limits, namely "minimum" or "lowest," would be use in connection with embodiments where the main supply 104 or the test supply 126 outputs a negative voltage. Likewise, relative terms such as "lower" would be replaced with the reverse relation, for example "higher;" and so on.

Figure 3:
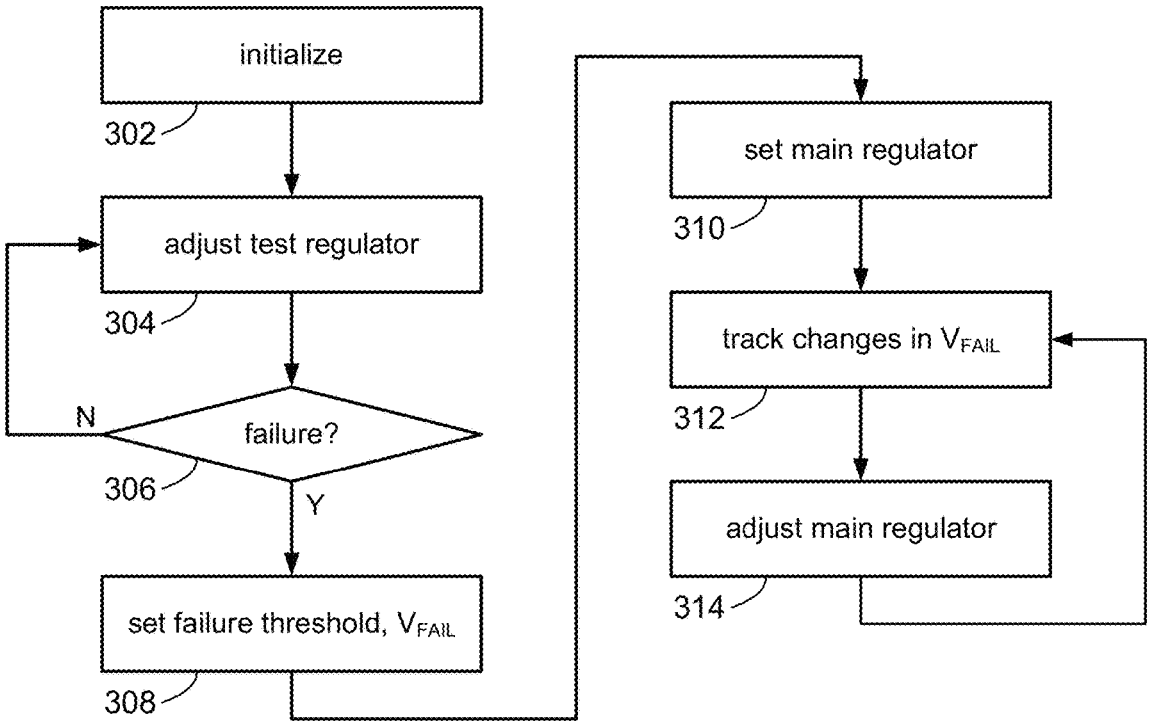
FIG. 3 shows a high level process flow of circuit operation in accordance with the present disclosure.

Referring to FIG. 3, a high level description of operation of the AVS circuitry 116 (FIG. 1) will now be described. The AVS circuitry 116 may be operated during circuit testing of IC 102 at the time of manufacture. The AVS circuitry 116 may also be operated in real time during operation of a system that incorporates IC 102. More particularly, FIG. 3 highlights actions that may be performed by the controller 124 in accordance with some embodiments of the present disclosure. In various embodiments, the controller 124 may include digital circuitry (e.g., processor, microcontroller, digital signal processor, field programmable gate arrays, etc.) suitably programmed or otherwise configured to perform the actions set forth in FIG. 3. In some embodiments, the controller 124 may further include analog circuitry, for example, to process signals 132 that are analog in nature; e.g., signals 132 that are characterized by a frequency, a voltage level, and so on.

At block 302, the controller 124 may set certain initial conditions. For example, the controller 124 may initialize the main regulator 104 to regulate the main supply voltage $V_{DD}$-main at a maximum voltage level. For example, a predefined maximum value may be stored in or otherwise accessible by the controller 124. Alternatively, the controller 124 may set the main regulator 104 to its maximum output level. The voltage level can be such as to ensure that all the circuitry in the core 114 operates correctly. Similarly, the controller 124 may initialize the test regulator 126 to regulate the test supply voltage $V_{DD}$-test to a maximum voltage, selected to ensure that the test circuit 122 is operating correctly.

At blocks 304, 306, the controller 124 may establish a threshold failure voltage $V_{FAIL}$. In some embodiments, for example, the controller 124 may repeat blocks 304 and 306 to incrementally lower the output of the test regulator 126 from it initial setting until the first occurrence of a failure is detected in the test circuit 122, thus establishing an initial value of the threshold failure voltage $V_{FAIL}$.

At block 304, for example, the controller 124 may adjust (e.g., via control signal 134) the test regulator 126 to lower the output level of the test supply voltage $V_{DD}$-test from a voltage level $V_1$ to another lower voltage level $V_2<V_1$ in order to induce a change in one or more characteristics of signals 132 from test circuit 122. The adjustment amount $\Delta=V_1-V_2$ can be a predetermined value, and in some embodiments may be the same with each iteration of block 304. In other embodiments, the adjustment amount 4 may vary from one iteration to the next. For example, the adjustment amount on the first iteration may be $\Delta_1$, then on the second iteration the adjustment amount may be $\Delta_2<\Delta_1$, the adjustment amount on the third iteration may be $\Delta_3<\Delta_2$, and so on. In still other embodiments, the adjustment amount 4 may vary in other ways.

At block 306, the controller 124 may assess the test circuit 122 for a failure in operation. In some embodiments, for example, the controller 124 may test the signals 132 from test circuit 122 to determine whether one or more characteristics of the signals 132 have changed or deviated from expected values or behavior as a result of the adjustment made to the output of test regulator 126. Merely to illustrate the point, suppose the test circuit 122 is a frequency divider. Adjusting the test regulator 126 may result in violations in the setup time or hold time in components of the frequency divider. Any such violations may manifest themselves in a change or deviation in the frequency of the resulting frequency-divided signal 132 produced by the test circuit 122.

If no change or deviation is detected in test signals 132, then the test circuit 122 may be deemed to be functioning properly under the present test supply voltage $V_{DD}$-test from test regulator 126. Accordingly, processing from block 306 will return to block 304, and the controller 124 may adjust the level of the test supply voltage $V_{DD}$-test to the next lower increment.

If a change or deviation is detected in test signals 132, then a failure in the test circuit 122 may be deemed to have occurred at the present output level of the test regulator 126. Processing may proceed to block 308. At block 308, the controller 124 may set a value for the threshold failure voltage $V_{FAIL}$. In some embodiments, for example, the threshold failure voltage $V_{FAIL}$ may be set equal to the last output level of the test regulator 126 at which the test circuit 122 properly functioned.

In some embodiments, as depicted in FIG. 3 for instance, the controller 124 may alternate between adjusting the test regulator 126 (block 304) and assessing the test circuit 122 for failure (block 306). In other embodiments, the controller 124 may perform several assessments of the test circuit 122 for failure between adjustments to the test regulator 126. For example, after the test regulator 126 is adjusted, the controller 124 may make n assessments of the test circuit 122 for failure before making the next adjustment to the test regulator 126. Such a delay between adjustments may allow a sufficient amount of time for the test circuit 122 to settle and for the operating temperature to change. Merely to illustrate this point, adjustments to the test regulator 126, for example, may be made every one or more minutes, while assessment of the test circuit 122 may be made every second. The adjustment period and the assessment period may be constant. In other embodiments, the adjustment period and assessment period may vary. For example, the controller 124 may vary either or both periods depending on operating temperature, amount of activity in the core 114, and so on.

At block 310, the controller 124 may set the main regulator 104 (e.g., via control signal 134) to output a regulated supply voltage (e.g., $V_{DD}$-main) that is lower than its initial maximum level (e.g., set at block 302), based on the initial determination of the threshold failure voltage $V_{FAIL}$ set at block 308. Assuming that the test circuit 122 is sufficiently representative of circuitry in the core 114, then adjusting the main regulator 104, which supplies the core 114, from its initial maximum level (e.g., set at block 302) to a lower level based on the threshold failure voltage $V_{FAIL}$ should continue to power the core 114 to operate correctly. In some embodiments, for example, the output of the main supply 104 may be set equal to the threshold failure voltage $V_{FAIL}$. However, since it is generally desirable to avoid allowing the core 114 to experience failure, it may be beneficial to add robustness to the main regulator 104 to ensure sufficient power to the core 114 by adding a margin to $V_{FAIL}$. For example, since no two circuits are exactly the same (e.g., due to process variations), the test circuit 122 and the core 114 may have some differences. Adding a margin can mitigate that. Accordingly, a margin $V_{margin}$ may be added to the threshold failure voltage $V_{FAIL}$, for example, the main supply 104 may be set to a level ($V_{FAIL}+V_{margin}$). In some embodiments, for example, $V_{margin}$ may be a predetermined value stored in the controller 124, or in a memory that can be accessed by the controller 124.

In other embodiments, $V_{margin}$ may be based on an attribute of the test regulator 126 known as the "dropout voltage." The dropout voltage of a voltage regulator is the smallest difference between the input voltage (e.g., $V_{DD}$-main) and output voltage (e.g., $V_{DD}$-test), below which the voltage regulator may not operate correctly; for example, the voltage regulator may cease to regulate against further reductions in the input voltage. If the main regulator 104 also supplies the test regulator 126, then the margin $V_{margin}$ may be the dropout voltage to ensure correct operation of the test regulator 126, while at the same time making the main regulator 104 more robust by outputting a supply voltage slightly higher than $V_{FAIL}$.

Setting the main regulator 104 to regulate its output to $V_{FAIL}+V_{margin}$, allows the main regulator 104 to power the core 114 at or near a minimum output level that can still sufficiently operate the core 114. In addition, the margin $V_{margin}$ provides a degree of robustness in providing power to the core 114. However, as explained above, changes in the operating temperature may affect the supply voltage needed for proper circuit operation of the core 114. If the operating temperature changes, the core 114 may no longer operate properly at the output level ($V_{FAIL}$ $V_{margin}$) from the main regulator 104.

Accordingly, at blocks 312 and 314, the controller 124 may periodically adjust the test supply voltage $V_{DD}$-test of test regulator 126 to small increments above the threshold failure voltage $V_{FAIL}$ and small increments below $V_{FAIL}$ in order to track changes in $V_{FAIL}$. The controller 124 may then adjust the main regulator 104 as $V_{FAIL}$ changes. In this way, the output of the main regulator 104 can track changes to $V_{FAIL}$ in order to supply the core 114 at or near a minimum output level that can still properly operate the core 114.

At block 312, for example, the controller 124 may increase the output level of the test regulator 126. Since the test circuit 122 is not functioning properly at the present output level of the test regulator 126 (e.g., from block 306), the controller 124 may increase the output of the test regulator 126 in small increments until the test circuit 122 begins to function properly again. The voltage at which proper function or operation of the test circuit 122 is restored may be higher than $V_{FAIL}$, for example, due to hysteresis effects in the test circuit 122. When proper operation of test circuit 122 is observed, the controller 124 may incrementally decrease the output of the test regulator 126 until failure in the test circuit 122 is once again observed. A new value for $V_{FAIL}$ may be established, for example, by using the last output level of the test regulator 126 at which the test circuit 122 functioned properly. This newly established value of $V_{FAIL}$ may be the same or different from the previously established value of $V_{FAIL}$. For example, if the operating temperature has not changed, then the new value of $V_{FAIL}$ may be the same as the previously established value of $V_{FAIL}$, whereas a change in the operating temperature may result in a different value of $V_{FAIL}$.

The frequency with which the output level of the test regulator 126 is incrementally increased and incrementally decreased may remain constant throughout the process. In other embodiments, the frequency may vary. For example, the frequency with which the increases are made may vary over time, and likewise the frequency with which the decreases are made may vary over time. In some embodiments, the frequency with which the increases are made may be the same or different from the frequency of decreases, and so on. The amount (increment) by which the output of the test regulator 126 changes may be same with each increase and each decrease. In some embodiments, the increments may vary. For example, the size of the increment may vary over time. The increments used to increase the output of the test regulator 126 may be the same or different from the increments used to decrease the output of the test regulator 126, and so on.

At block 314, the controller 124 may adjust the main regulator 104 as changes in $V_{FAIL}$ occur in order to maintain the main supply voltage $V_{DD}$-main at a minimum and adequate level to supply the core 114. In some embodiments, the main regulator 104 may supply the test regulator 126, as shown in FIG. 1. The controller 124 may monitor the levels of $V_{DD}$-main and $V_{DD}$-test. As explained above, the main supply voltage $V_{DD}$-main and the test supply voltage $V_{DD}$-test may be provided to the controller 124. The controller 124 may convert the voltage levels to a digital format, for example, using an ADC. In other embodiments, the analog voltage level conversion to digital format may occur outside of the controller 124. The controller 124 may compute or otherwise determine a difference between the voltage levels of the main supply voltage $V_{DD}$-main and the test supply voltage $V_{DD}$-test. In some embodiments, the difference may be generated separately from the controller 124 and provided directly to the controller 124.

The controller 124 may adjust the output of the main regulator 104 to maintain the difference between $V_{DD}$-main and $V_{DD}$-test at or above the margin $V_{margin}$. For example, if $V_{FAIL}$ increases by an amount δ, then the controller 124 may adjust the main regulator 104 to increase $V_{DD}$-main by a similar amount and conversely, if $V_{FAIL}$ decreases, then the controller 124 may adjust the main regulator 104 to decrease $V_{DD}$-main.

Processing in the controller 124 may repeat blocks 312 and 314 to iteratively track changes in $V_{FAIL}$ and adjust the main regulator 104 as $V_{FAIL}$ changes. Persons of ordinary skill will appreciate from the foregoing that ICs (e.g., IC 102) in accordance with the present disclosure can be operated with minimum power supply voltage, thus minimizing power consumption while ensuring proper operation under varying ambient operating temperatures. For example, the main regulator 104 can be operated to output a regulated supply voltage near a minimum level (e.g., $V_{FAIL}$) that can still properly operate the core 114. By monitoring changes in $V_{FAIL}$ as the ambient operating temperature varies during operation of the IC 102 and adjusting the output level of the main regulator 104 accordingly, the main regulator 104 can continue to operate the core 114 at or near the minimum output level despite changes in the operating temperature.

Circuits in accordance with the present disclosure may be more efficiently implemented on silicon. For example, the clock frequency may be doubled, nearly halving the silicon size for many functions, by using fast transistors (e.g., ULVTs) instead of slower devices. ULVTs only slightly increase unit cell size, but that is negligible when compared to halving the size of the entire circuit. ULVTs tend to increase power, which can be countered by AVS circuitry (e.g., 116, FIG. 1) in accordance with the present disclosure.

The discussion will now turn to additional embodiments of circuits in accordance with the present disclosure.

Figure 4:
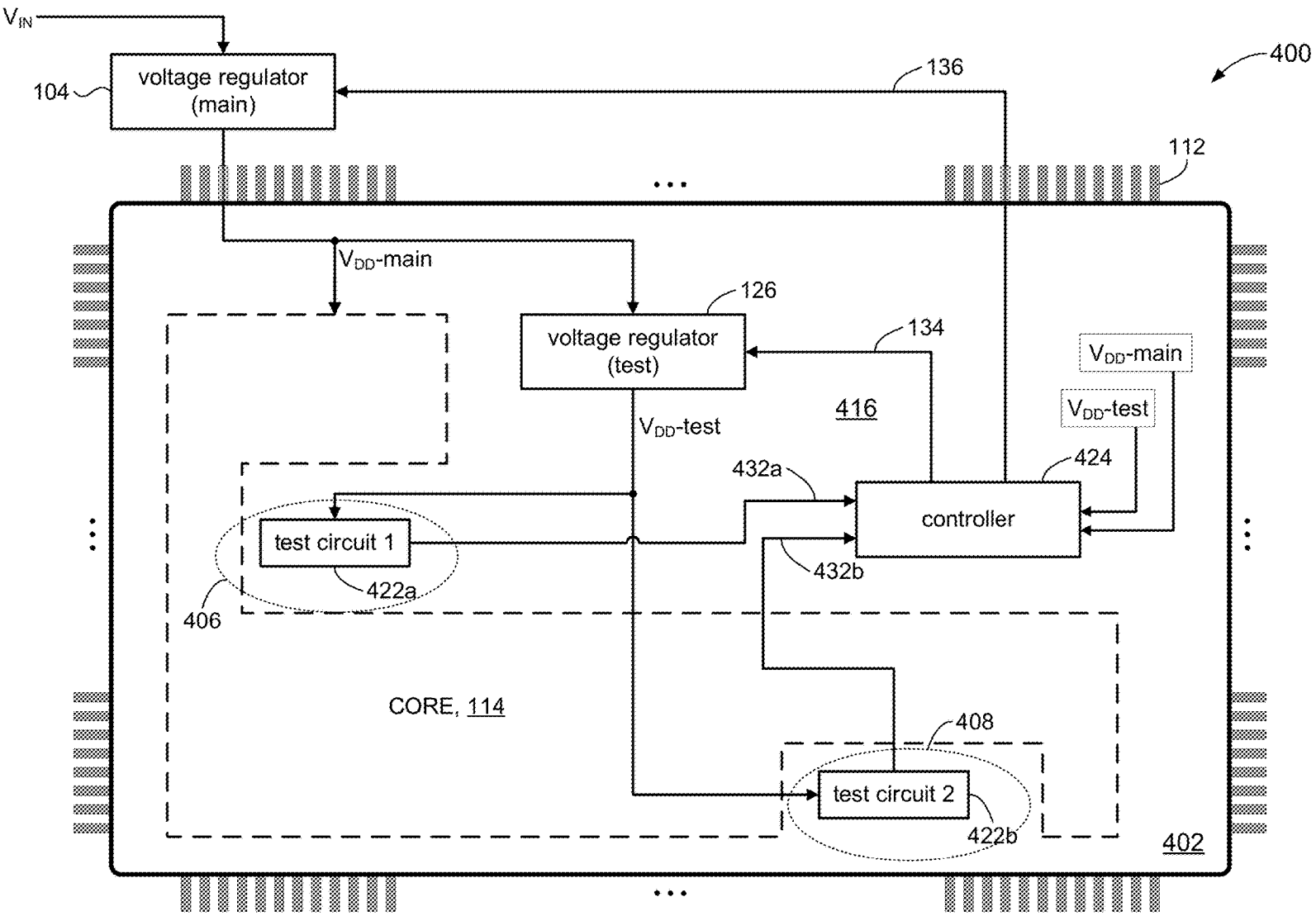
FIG. 4 illustrates an alternative embodiment of the circuit shown in FIG. 1 in accordance with the present disclosure.

Referring to FIG. 4, a circuit 400 in accordance with some embodiments of the present disclosure may comprise a main regulator 104 and IC 402. The main regulator 104 may provide a regulated supply voltage to the core 114 on IC 402. In accordance with the present disclosure, IC 402 may include AVS circuitry 416 comprising several (two or more) test circuits 422*a*, 422*b*, a controller 424, and test regulator 126. The test circuit 422*a* may be fabricated at a first location 406 on IC 402, and the test circuit 422*b* may be fabricated at a second location 408 on IC 402 different from the first location 406. Test circuit 422*a* may provide one or more (test) signals 432*a* generated by test circuit 422*a* to the controller 424. Likewise, test circuit 422*b* may provide one or more (test) signals 432*b* generated by test circuit 422*b* to the controller 424. In some embodiments, not shown, either controller 424 or test regulator 126 may be provided off-chip with respect to IC 402, as shown for example in FIG. 2A. In other embodiments, both controller 424 and test regulator 126 may be provided off-chip.

The test circuits 422*a*, 422*b* can serve to monitor circuit operations (e.g., switching speed, setup and hold times, etc.) across different locations on the semiconductor die of IC 402. Circuit operation may vary at different locations on the die due to process variations which can result, for example, in variations in doping levels across the die, variations in device geometry (e.g., oxide thicknesses, line widths, etc.), and the like. Variations in circuit operation may also arise as a result of a temperature gradient forming on IC 402, for example due to different parts of the core 114 being more active than other parts of the core 114, resulting in different temperatures at different locations on the die. Circuit operation at different locations on the die may also be affected by variability of the main supply voltage $V_{DD}$-main across the die, caused for instance by varying IR drops from location to location.

The test circuits 422*a*, 422*b* may comprise the same or different circuitry. For example, test circuit 422*a* may comprise circuitry that is representative of circuitry in the core 114 in the vicinity of location 406 of IC 402, and test circuit 422*b* may comprise circuitry that is representative of circuitry in the core 114 in the vicinity of location 408 of IC 402. For instance, if circuitry in core 114 in the vicinity of location 406 is an arithmetic logic unit (ALU) of a processor, then test circuit 422*a* may comprise circuits that are similar to the circuitry in the ALU, or the test circuit 422*a* may comprise circuits that are identical to certain circuits in the ALU. Likewise, if the core 114 in the vicinity of location 408 is a dynamic random access memory (DRAM), the test circuit 422*b* may comprise some number of the memory cells that comprise the DRAM. Selecting circuitry for test circuits 422*a*, 422*b* in this way allows the test circuits 422*a*, 422*b* to more accurately monitor changes in circuit operation (e.g., due to changes in operating temperature) at their respective locations 404, 406 on IC 402.

Figure 5:
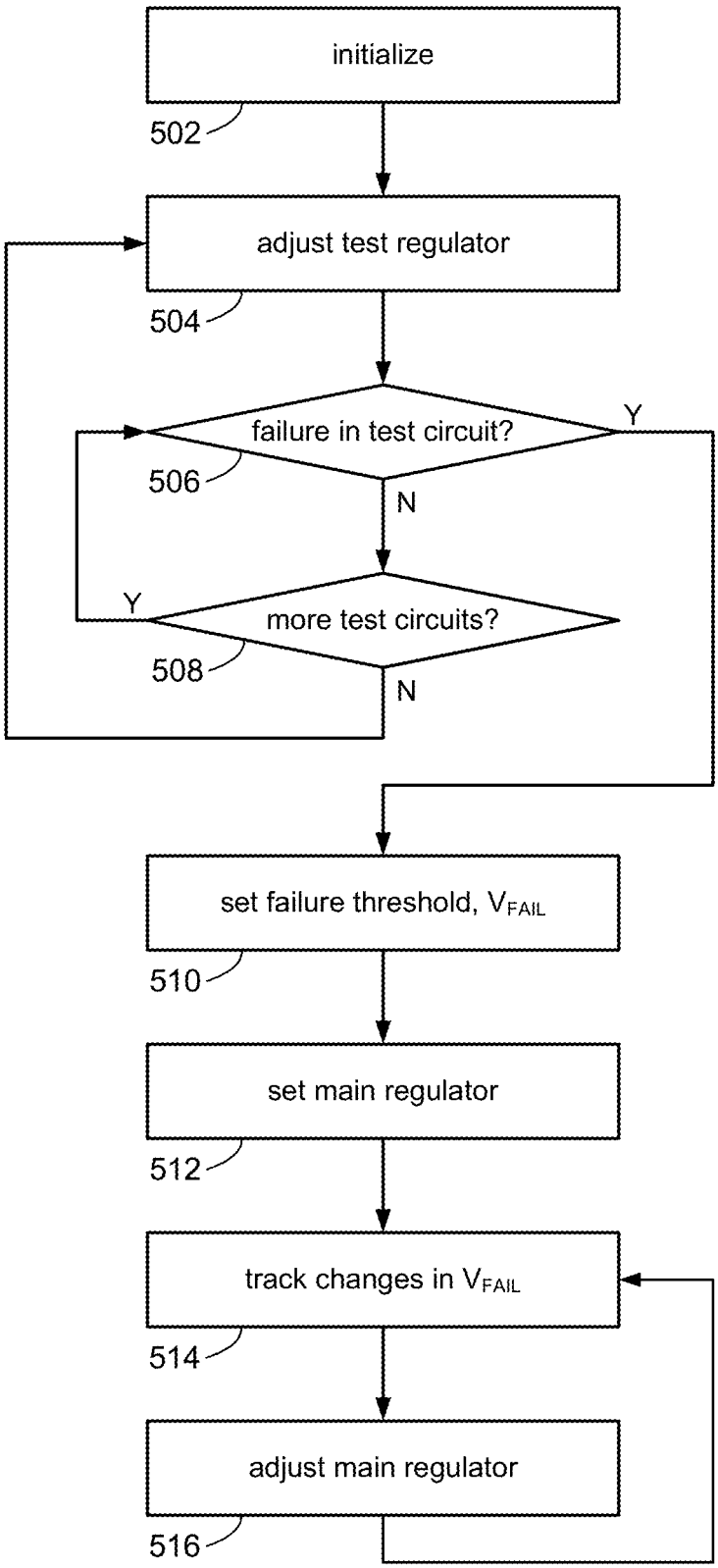
FIG. 5 shows a high level process flow of an alternative embodiment of circuit operation in accordance with the present disclosure.

Referring to FIG. 5, a high level description of operation of the AVS circuitry 416 shown in FIG. 4 will now be described. The AVS circuitry 416 may be operated during circuit testing of IC 402 (e.g., at the time of manufacture) and during actual (real time) operation in a system that incorporates IC 402. FIG. 5 highlights actions performed by the controller 424 in accordance with the present disclosure, although reference may be made to FIG. 3 for aspects of the process that may already be depicted FIG. 3.

At block 502, the controller 424 may set initial conditions. For example, the main regulator 104 and test regulator 126 may be set to respective maximum output levels as explained in more detail, for example, in connection with block 302 in FIG. 3.

At blocks 504, 506, 508 the controller 424 may establish a threshold failure voltage $V_{FAIL}$. In some embodiments, for example, the controller 424 may repeat the loop 504-508 to incrementally lower the output of the test regulator 126 until the first occurrence of a failure is detected among the test circuits 422*a*, 422*b*, thus establishing an initial value of $V_{FAIL}$, as explained above in FIG. 3 for example.

At block 504, for example, the controller 424 may adjust the test regulator 126 (e.g., via control signal 134) to lower its output (e.g., $V_{DD}$-test) from an initial voltage level $V_1$ (e.g., set at block 502) to another lower voltage level $V_2<V_1$ in order to induce a change in one or more characteristics of signals 432*am*, 432*b* from respective test circuit 422*a*, 422*b*. This process is similar to block 304 in FIG. 3.

The controller 424 may repeat loop 506, 508 to assess each of the test circuits 422*a*, 422*b* in IC 402 for a failure for the given output level of test regulator 124. As soon as a failure is detected (e.g., Y branch at block 506), the controller 424 may exit the loop 506, 508, and continue to block 510. If a failure is not detected in any of the test circuits 422*a*, 422*b*, then the controller may return to block 504 to adjust the output level of the test regulator 126 to the next increment for another iteration of loop 50, 508.

At block 510, the threshold failure voltage $V_{FAIL}$ may be set to the previously adjusted output level of test regulator 126 at which none of the test circuits 422*a*, 422*b* exhibited a failure.

At block 512, the controller 424 may adjust the main regulator 104 based on $V_{FAIL}$. For example, the main regulator 104 may be adjusted to output a level equal to $V_{FAIL}$ $V_{margin}$.

The controller 424 may repeat loop 514, 516 to monitor changes in $V_{FAIL}$ (e.g., due to changes in operating temperature) and adjust the main regulator 104 as $V_{FAIL}$ varies. At block 514, for example, the controller 424 may adjust the test regulator 126 to incrementally increase its output until all the test circuits 422*a*, 422*b* resume proper operation. When proper operation of all the test circuits 422*a*, 422*b* is observed, the controller 424 may incrementally decrease the output of the test regulator 126 until the first failure in one of the test circuits 422*a*, 422*b* is observed, thus establishing a new value for $V_{FAIL}$, as explained above in connection with FIG. 3 for example.

At block 516, the controller 242 may adjust the main regulator 104 according to the newly established value for $V_{FAIL}$, for example, by adding the margin $V_{margin}$ to $V_{FAIL}$. Processing in the controller 424 may return to block 514 for additional iterations of tracking $V_{FAIL}$ and adjusting the main regulator 104.

Figure 6:
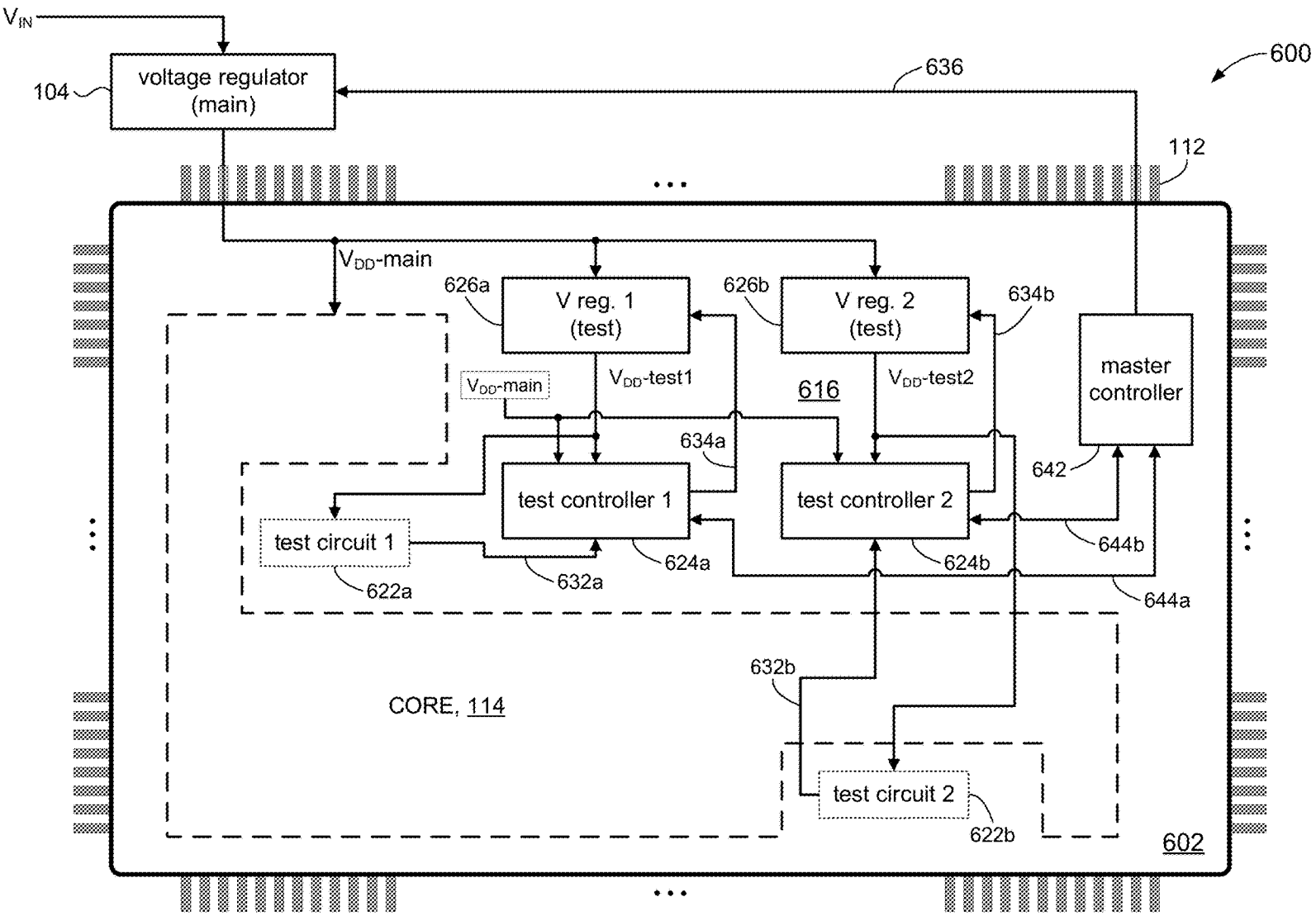
FIG. 6 illustrates an alternative embodiment of the circuit shown in FIG. 1 in accordance with the present disclosure.

Referring to FIG. 6, a circuit 600 in accordance with some embodiments of the present disclosure may comprise a main regulator 104 and IC 602. The main regulator 104 may provide a regulated supply voltage to the core 114 on IC 602. In accordance with the present disclosure, IC 602 may include AVS circuitry 616 comprising several (two or more) test circuits 622*a*, 622*b* distributed at different locations across the die of IC 602, for example, in order to monitor variations in circuit operation across IC 602. The test circuits 622*a*, 6422*b* may comprise the same or different circuitry. Each test circuit 622*a*, 622*b* may be supplied by a respective test regulator 626*a*, 626*b*. In some embodiments, the test regulators 626*a*, 626*b*, in turn, may be supplied by main regulator 104; although in other embodiments, either or both test regulators 626*a*, 626*b* may be supplied by a source other than main regulator 104. Each test circuit 622*a*, 622*b* may generate respective test signals 632*a*, 632*b*, which can be provided to respective test controllers 624*a*, 624*b*. The test controllers 624*a*, 624*b* may generate control signals 634*a*, 634*b* to control respective test regulators 626*a*, 626*b*. FIG.

6 shows that the test regulators 626*a*, 626*b* each supply a single respective test circuit 622*a*, 622. However, in some embodiments a test regulator (e.g., 626*a*) may supply two or more test circuits (not shown), as depicted in FIG. 4 for example.

The AVS circuitry 616 may include a master controller 642. Control signals 644*a*, 644*b* may be communicated between the master controller 642 and respective test controllers 624*a*, 624*b*. Test controllers 624*a*, 624*b* may provide information to the master controller 642 via respective control signals 644*a*, 644*b*. Conversely, the master controller 642 may inform and/or control each test controller 624*a*, 624*b* via respective control signals 644*a*, 644*b*. The master controller 642 may control the main regulator 104 via a control signal 636.

FIG. 6 shows that the master controller 642, test controllers 624*a*, 624*b*, and test regulators 626*a*, 626*b* are all fabricated on IC 602. In some embodiments (not shown) the master controller 642 may be provided off-chip with respect to IC 602. In other embodiments, test controllers 624*a*, 624*b* may be off-chip as well as test regulator 626*a*, 626*b*. In still other embodiments, depending on area constraints of IC 602, any combination of master controller 642, test controllers 624*a*, 624*b*, and test regulators 626*a*, 626*b* may be provided off-chip.

Figure 7:
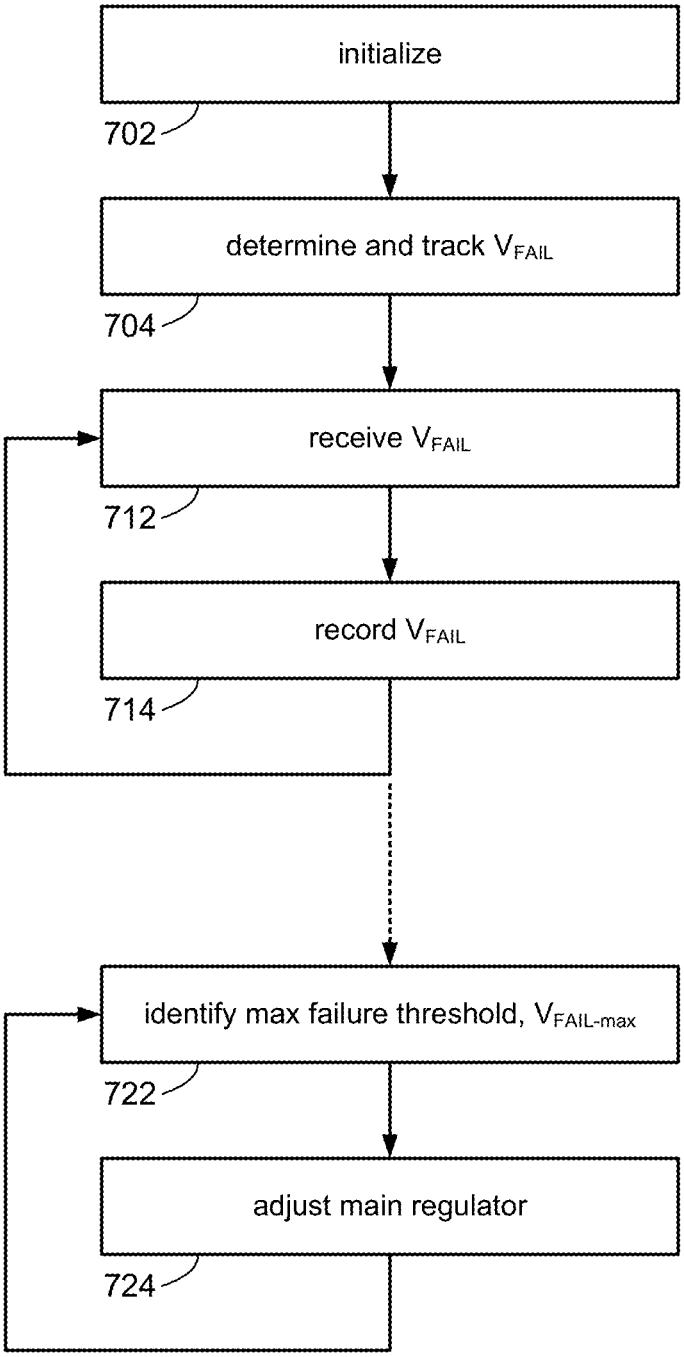
FIG. 7 shows a high level process flow of an alternative embodiment of circuit operation in accordance with the present disclosure.

Referring to FIG. 7, a high level description of operation of the AVS circuitry 616 shown in FIG. 6 will now be described. The AVS circuitry 616 may be operated during circuit testing of IC 602 (e.g., at the time of manufacture) and during actual (real time) operation in a system that incorporates IC 602. FIG. 7 highlights actions performed by the master controller 642 in accordance with the present disclosure, although reference may be made to FIG. 3 and/or FIG. 5 for aspects of the process that are depicted in either or both the figures.

At block 702, the master controller 642 may set initial conditions. For example, the master controller 642 may control the main regulator 104 (e.g., via control signal 636) to generate a predefined maximum regulated supply voltage. The master controller 646 may likewise control the test controllers 624*a*, 624*b* (e.g., via respective control signals 644*a*, 644*b*) to set their respective test regulators 626*a*, 626*b* to maximum output levels, as explained in more detail, for example, in connection with block 302 in FIG. 3.

At block 704, the master controller 642 may control the test controllers 624*a*, 624*b* to identify and track $V_{FAIL}$ for each of their respective test circuits 622*a*, 622*b*. In response, each test controller 624*a*, 624*b* may perform processing on their respective test circuits 622*a*, 622*b* and respective test regulators 626*a*, 626*b*. In some embodiments, processing in each test controller 624*a*,624*b* may proceed independently of each other. Processing in each test controller 624*a*, 624*b* may proceed in a manner similar to that shown in FIG. 3 (or FIG. 5 in the case of a single test controller being associated with multiple test circuits). However, in accordance with some embodiments of the present disclosure, the test controllers 624*a*, 624*b* may report their $V_{FAIL}$ determinations to the master controller 642 instead of adjusting the main regulator 104. Thus, for example, at block 310 in FIG. 3, instead of adjusting the main regulator 104, the test controller (e.g., 624*a*) may report $V_{FAIL}$ to the master controller 642, for example, via control signal 644*a*. Likewise for block 512 in FIG. 5.

Continuing with FIG. 7, the master controller 642 may iterate a data collection loop comprising blocks 712, 714. At block 712, for example, the master controller 642 may receive from the test controllers 624*a*, 624*b* their respective latest values of $V_{FAIL}$. At block 714, the master controller 642 may collect and record the received values of $V_{FAIL}$ in a suitable way.

The master controller 642 may iterate a $V_{FAIL}$ tracking loop comprising blocks 722, 724. At block 722, for example, the master controller 642 may identify the largest value of $V_{FAIL}$, call it $V_{FAIL\text{-}max}$, from among the recorded values of $V_{FAIL}$ (e.g., being collected at block 714). The portion of the core 114 represented by the test circuit having the highest failure voltage $V_{FAIL\text{-}max}$ may be viewed as being the "weakest" circuitry in the core 114. Setting the main regulator 104 to the highest threshold failure voltage $V_{FAIL\text{-}max}$ may ensure that all the circuitry in the core 114 operates properly, including the weakest circuitry in the core 114. Accordingly, at block 724, the master controller 642 may adjust the main regulator 104 based on the highest threshold failure voltage $V_{FAIL\text{-}max}$ plus a suitable margin (e.g., $V_{margin}$).

In some embodiments, the data collection loop 712, 714 may be performed independently of the $V_{FAIL}$ tracking loop 722, 724. Decoupling the two loops provides the master controller 642 flexibility in scheduling when to make adjustments to the main regulator (block 722), selecting criteria for deciding whether to make an adjustment, and so on.

The above description illustrates various embodiments of the present disclosure along with examples of how aspects of the particular embodiments may be implemented. The above examples should not be deemed to be the only embodiments, and are presented to illustrate the flexibility and advantages of the particular embodiments as defined by the following claims. Based on the above disclosure and the following claims, other arrangements, embodiments, implementations and equivalents may be employed without departing from the scope of the present disclosure as defined by the claims.

What is claimed is:

1. A circuit comprising:

a first voltage regulator to produce a first regulated supply voltage for a main circuit;

a second voltage regulator to produce a second regulated supply voltage;

a plurality of test circuits to produce respective test signals, each having a characteristic dependent on the second regulated supply voltage; and a controller to control the second voltage regulator to adjust the second regulated supply voltage to one or more threshold levels determined based only on changes detected in the characteristics of the respective test signals produced by the plurality of test circuits, the controller to control the first voltage regulator to adjust the first regulated supply voltage based on a threshold level of the second regulated supply voltage among the one or more threshold levels having a maximum value.

2. The circuit of claim 1, wherein the adjusted first regulated supply voltage is different than the threshold level by a margin.

3. The circuit of claim 1, wherein the plurality of test circuits are representative of a portion of the main circuit.

4. The circuit of claim 3, wherein the plurality of test circuits comprise circuitry identical to circuitry in the main circuit.

5. The circuit of claim 1, wherein the characteristic includes at least one of a frequency, a bit count, a bit sequence, bit errors, logic value, a voltage level, a current level and signal quality.

6. The circuit of claim 1, wherein the main circuit and the plurality of test circuits are on the same circuit.

7. The circuit of claim 1, wherein the controller further:

controls the second voltage regulator to repeatedly adjust the second regulated supply voltage to determine an updated threshold level; and controls the first voltage regulator to adjust the first regulated supply voltage based on the updated threshold level.

8. The circuit of claim 1, wherein the second voltage regulator is powered from the first regulated supply voltage.

9. The circuit of claim 1, wherein at least some of the characteristics are different from each other.

10. The circuit of claim 1, wherein the plurality of test circuits are distributed at different locations in the circuit.

11. The circuit of claim 1, further comprising a corresponding plurality of second voltage regulators and controllers for the plurality of test circuits, the plurality of controllers to determine a plurality of threshold levels corresponding to the plurality of test circuits, the circuit further comprising a master controller to control the first voltage regulator to adjust the first regulated supply voltage.

12. The circuit of claim 1, wherein the controller controls the first voltage regulator and the second voltage regulator during operation of circuitry that comprise the circuit.

13. A method in a circuit comprising:

producing a first regulated supply voltage for a main circuit;

producing at least one second regulated supply voltage for a plurality of test circuits;

determining a plurality of threshold levels for the plurality of test circuits, including:

producing one or more test signals, each having a characteristic dependent on the at least one second regulated supply voltage; and adjusting the at least one second regulated supply voltage to a threshold level that is determined based only on changes detected in the characteristic of the one or more test signals produced by said each test circuit; and adjusting the first regulated supply voltage based on a maximum threshold level among the plurality of threshold levels.

14. The method of claim 13, further comprising adjusting the first regulated supply voltage to differ from the maximum threshold level by a margin.

15. The method of claim 13, further comprising producing the at least one second regulated supply voltage from the first regulated supply voltage.

16. The method of claim 13, further comprising determining the plurality of threshold levels for the plurality of test circuits at different locations in the circuit.

17. The method of claim 13, further comprising powering the plurality of test circuits with a respective plurality of independently produced second regulated supply voltages, and adjusting the plurality of second regulated supply voltages independently of each other to determine the plurality of threshold levels.

18. The circuit of claim 1, wherein the controller controls the second voltage regulator without the controller comparing the respective test signals to a reference signal.

19. The circuit of claim 1, wherein the controller controls the second voltage regulator to adjust the second regulated supply voltage to the one or more threshold levels based on a relation between the respective test signals.

20. The circuit of claim 1, wherein the respective test signals are digital signals.

* * * * *